US011667046B2

(12) United States Patent
Washington

(10) Patent No.: US 11,667,046 B2
(45) Date of Patent: Jun. 6, 2023

(54) APPARATUS AND METHOD FOR SPLITTING LOGS

(71) Applicant: Peter Washington, Salem, OR (US)

(72) Inventor: Peter Washington, Salem, OR (US)

( * ) Notice: Subject to any disclaimer, the term of this patent is extended or adjusted under 35 U.S.C. 154(b) by 184 days.

(21) Appl. No.: 16/918,850

(22) Filed: Jul. 1, 2020

(65) Prior Publication Data

US 2021/0001509 A1 Jan. 7, 2021

Related U.S. Application Data

(60) Provisional application No. 62/870,521, filed on Jul. 3, 2019.

(51) Int. Cl.
*B26B 23/00* (2006.01)
*B27L 7/00* (2006.01)
*B27L 7/06* (2006.01)

(52) U.S. Cl.
CPC ..... *B26B 23/00* (2013.01); *B27L 7/005* (2013.01); *B27L 7/06* (2013.01)

(58) Field of Classification Search
CPC ..... B26B 23/00; B27L 7/005; B27L 7/06
USPC ..... 30/308.1–308.3; D8/76; 144/195.5, 144/195.7
See application file for complete search history.

(56) References Cited

U.S. PATENT DOCUMENTS 128,830 A 7/1872 Wagner
401,327 A * 4/1889 Bryant ..... B25B 7/22 30/308.1
570,188 A * 10/1896 Roseman ..... B26B 17/00 30/308.1
574,716 A * 1/1897 Crabtree ..... B26B 23/00 30/308.3
607,448 A * 7/1898 Morris ..... B25B 7/22 30/308.1
736,435 A * 8/1903 Parbel ..... B25F 1/00 30/308.1
1,084,990 A * 1/1914 Williams ..... B26B 23/00 30/DIG. 8

(Continued)

FOREIGN PATENT DOCUMENTS

CA 2380788 A1 * 10/2003 ..... B26B 23/00
DE 102012105098 A1 * 12/2013 ..... B27L 7/06

(Continued)

*Primary Examiner* — Jason Daniel Prone
(74) *Attorney, Agent, or Firm* — Mohr IP Law Solutions, PC

(57) ABSTRACT

One embodiment for splitting logs is described as including a first handle; a second handle; a unitary body wedge comprising a cutting wedge coupled to the first handle and a splitting wedge coupled to the second handle, wherein the first handle and the second handle are co-aligned along an axis of the log splitting tool when the cutting wedge and the splitting wedge form the unitary body wedge. As a user swings the log splitting tool in an overhead arc, driving the unitary body wedge into a log that is to be split, a cutting edge of the cutting wedge is driven downward into the log. The user spreads the first and second handles apart in opposing directions so that leverage created by the length of the first and second handles force the cutting wedge and the splitting wedge to separate apart from each other, causing the log to split.

20 Claims, 8 Drawing Sheets

(56) References Cited

U.S. PATENT DOCUMENTS 1,220,858 A * 3/1917 Flepsch ..... B26B 23/00 30/308.2
2,989,100 A * 6/1961 Burdis et al. ..... B26B 23/00 30/308.2
4,130,270 A 12/1978 Andersson
4,244,407 A 1/1981 McMullin
4,354,537 A 10/1982 Balkus
4,372,360 A * 2/1983 Eichlin ..... B26B 23/00 30/308.1
4,381,809 A 5/1983 Kenjorski
4,440,205 A * 4/1984 Hillinger ..... B26B 23/00 30/308.1
4,465,113 A * 8/1984 Hillinger ..... B26B 23/00 144/195.7
4,467,851 A * 8/1984 Hockman ..... B26B 23/00 144/195.7
4,789,134 A 12/1988 Tenuto, Jr. et al.
5,020,225 A * 6/1991 Stellrecht ..... B26B 23/00 30/308.1
5,347,718 A * 9/1994 Turner ..... B26B 23/00 30/308.1
5,454,410 A 10/1995 Edfors
D384,264 S * 9/1997 Liou ..... B25B 7/22 D8/76
6,289,955 B1 9/2001 Wilhelm
6,533,004 B1 3/2003 Thor
7,040,362 B1 5/2006 Monuik et al.
D939,914 S * 1/2022 Povey ..... B25B 7/22 D8/76
2011/0126942 A1 6/2011 Larson et al.
2021/0001510 A1* 1/2021 Washington ..... B26B 23/00

FOREIGN PATENT DOCUMENTS

SE 529365 C2 * 7/2007 ..... B26B 23/00
WO WO-2008030169 A1 * 3/2008 ..... B26B 23/00

* cited by examiner

APPARATUS AND METHOD FOR SPLITTING LOGS

CLAIM OF PRIORITY

This application claims priority to U.S. provisional application entitled, "Log Splitting Tool," having Ser. No. 62/870,521, filed Jul. 3, 2019, which is entirely incorporated herein by reference.

BACKGROUND OF THE INVENTION

Various apparatus and methods are known for splitting log sections for use as firewood. A person can manually split wood sections using an ax by driving the ax head into the top surface of the log one or more times. At some point, after driving the ax head into the surface of the log the log splits. However, splitting logs in this manner can be very time consuming and labor intensive.

Machine type log splitters use a mechanical force to push a log splitting wedge into the top surface of the log. Eventually, as the wedge is driven further into the log, the log splits. However, such mechanical log splitting machines can be relatively expensive to manufacture, purchase, and/or rent.

Accordingly, there is a need in the arts for a more efficient and economical manual log splitting system and method.

SUMMARY OF THE INVENTION

Embodiments of the log splitting tool facilitate splitting of logs. One embodiment for splitting a log comprises a first handle; a second handle; a unitary body wedge comprising a cutting wedge coupled to the proximal end of the first handle and a splitting wedge coupled to the proximal end of the second handle, wherein the first handle and the second handle are co-aligned along an axis of the log splitting tool when the cutting wedge and the splitting wedge form the unitary body wedge. As a user swings the log splitting tool in an overhead arc, driving the unitary body wedge into a log that is to be split, a cutting edge of the cutting wedge is driven downward into the log. The user spreads the first and second handles apart in opposing directions along a horizontal plane so that leverage created by the length of the first and second handles force the cutting wedge and the splitting wedge to separate apart from each other, causing the log to split.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
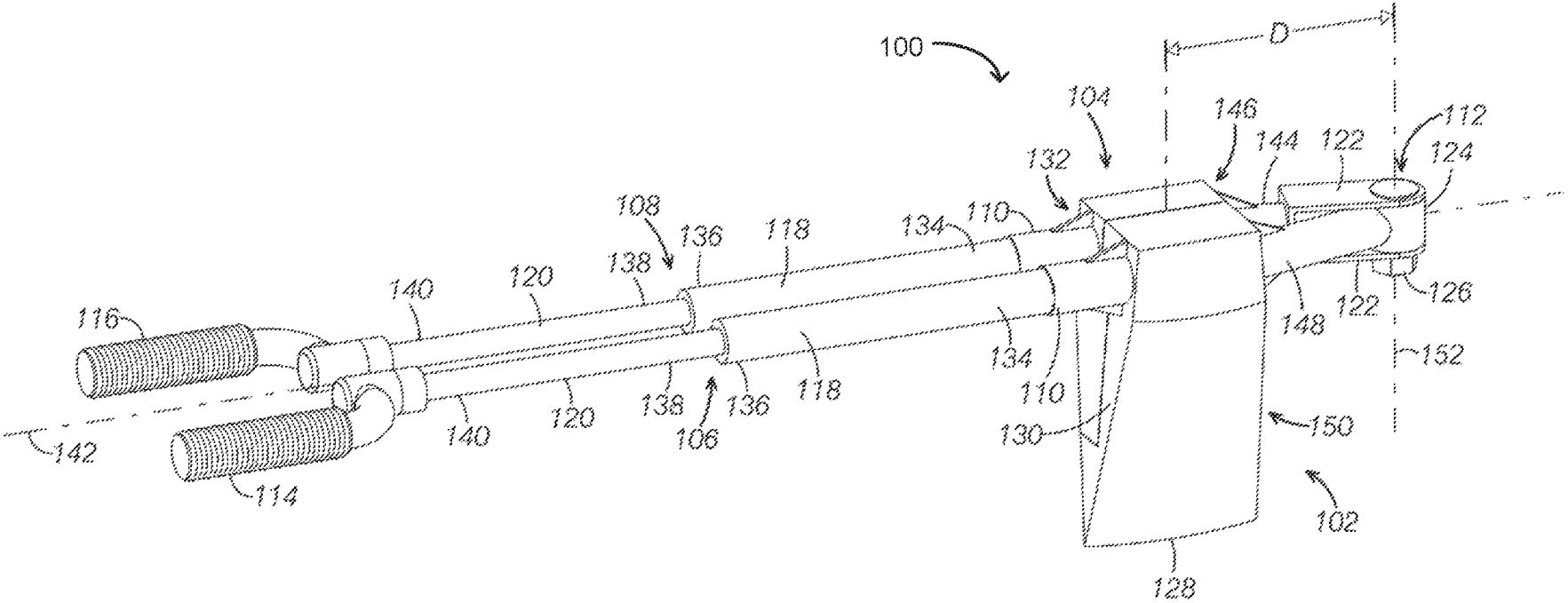
FIG. 1 is a perspective side view of an example embodiment of a log splitting tool.
Figure 2:
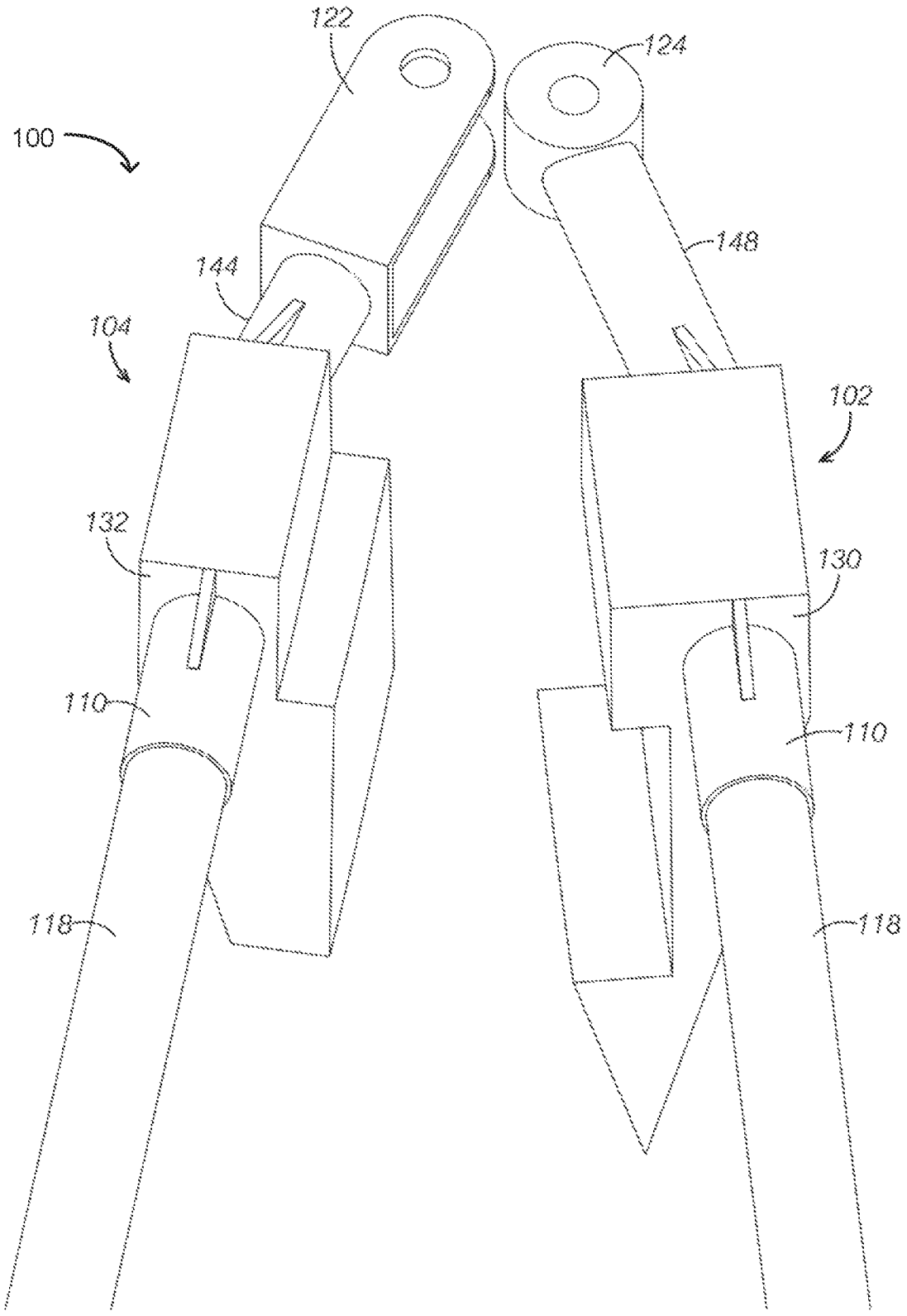
FIG. 2 is a perspective top view of an example embodiment of the log splitting tool.

FIG. 1 illustrates an example embodiment of log splitting tool 100. FIG. 2 is a perspective top view of an example embodiment of the log splitting tool 100. Embodiments of the log splitting tool 100 comprise a cutting wedge 102, a splitting wedge 104, a first telescoping handle 106, a second telescoping handle 108, optional braces 110, a handle connecting hinge 112, a first hand grip 114 and a second hand grip 116. The first telescoping handle 106 and the second telescoping handle 108 each comprise a barrel sleeve 118 and a handle plunger rod 120. The example handle connecting hinge 112 comprises two hinge loops 122, a hinge barrel 124, and a connecting pin 126. The cutting wedge 102 includes a sharpened cutting edge 128 that is driven downward into a top surface of a log that is to be split using the log splitting tool 100.

Similar to using a traditional ax to split a log, the user brings the first telescoping handle 106 and the second telescoping handle 108 together, thereby joining the cutting wedge 102 and the splitting wedge 104 together to form a unitary body wedge. The user then swings the log splitting tool 100 in an overhead arc, forcibly driving the unitary body wedge downward and into the upper surface of the log that is to be split. To split the log after the unitary body wedge has been driven into the log, the user grasps the first hand grip 114 and the second hand grip 116, and then spreads the hand grips 114, 116 apart in opposing directions along a horizontal plane. The leverage created by the length of the first telescoping handle 106 and the second telescoping handle 108 forces the cutting wedge 102 and the splitting wedge 104 to separate apart from each other, thereby causing the log to split as intended.

The disclosed systems and methods for using the log splitting tool 100 to split logs will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods to split logs using the log splitting tool 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The various disclosed log splitting tool 100 embodiments will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of log splitting tools 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Returning to FIGS. 1 and 2, in an example embodiment, one of the optional braces 110 is secured to the distal end surface 130 of the cutting wedge 102 and the other one of the braces 110 is secured to the distal end surface 132 of the splitting wedge 104. The braces 110 are secured to the surfaces 130, 132 by welding in a preferred embodiment. In other embodiments, the braces may be secured in any suitable manner, such as by having a portion of the brace 110 formed as a threaded protruding bolt that is screwed into a hole with mating threads disposed in the surface 130, 132. In another embodiment, the braces 110 are fabricated with the cutting wedge 102 and the splitting wedge 104 as a unibody structure.

A proximal end 134 of the barrel sleeves 118 are configured to be secured to the brace 110 so as to attach the first telescoping handle 106 and the second telescoping handle 108 to the cutting wedge 102 and the splitting wedge 104, respectively. In a preferred embodiment, the exterior surface of the proximal end 134 of the barrel sleeve 118 is threaded so that the barrel sleeve 118 can be turned so as to screw into corresponding mating interior threads disposed in an end hole of the brace 110. Alternatively, the brace 110 may include an outwardly protruding bolt portion that is threaded to match interior threads formed on an inside surface of the proximal end 134 of the barrel sleeve 118. In another embodiment, the proximal end 134 of the barrel sleeve 118 is welded to the brace 110. An advantage of the braces 110 is to provide a reinforcing structure to resist damage to the log splitting tool 100 during use. Any method of securing the first telescoping handle 106 to the cutting wedge 102 and securing the second telescoping handle 108 to the splitting wedge 104 may be used by alternative embodiments. In another alternative embodiment, the braces 110 are omitted, and the proximal end 134 of the barrel sleeves 118 are directly secured to the cutting wedge 102 and the splitting wedge 104 in any suitable manner as described herein above.

Preferably, the first telescoping handle 106 and second telescoping handle 108 are tubular. Accordingly, the distal end 136 of the barrel sleeves 118 are configured to slidably receive the proximal end 138 of the handle plunger rod 120. In practice, the handle plunger rod 120 may be slid down into the interior of the tube of the barrel sleeve 118, thereby shortening the overall length of the first telescoping handle 106 and the second telescoping handle 108. The shortened length may facilitate transportation of the log splitting tool 100. Further, in a non-limiting example embodiment, the length of the barrel sleeves 118 generally correspond to the length of a legacy ax handle. In use, the handle plunger rod 120 is fully inserted, or substantially inserted, into the barrel sleeves 118 for log splitting. Then after the user had driven the unitary body wedge (formed by joining the cutting wedge 102 and the splitting wedge 104 together) into the surface of the log, the user may then pull the handle plunger rods 120 out from the barrel sleeves 118 so as to increase the length of the first telescoping handle 106 and the second telescoping handle 108. Since the distance of the hand grips 114, 116 from the unitary body wedge has been increased by the extension of the first telescoping handle 106 and the second telescoping handle 108, leverage is increased when the user spreads the hand grips 114, 116 apart along the horizontal plane to split the log.

In an alternative embodiment, the first telescoping handle 106 and the second telescoping handle 108 are replaced with solid handles. Here, the user simply grasps the hand grips 114, 116, and then spreads the hand grips 114, 116 apart along a horizontal plane in opposing directions to split the log. Such an embodiment may be more economical to produce, and/or are suitable for smaller and/or easier-to-split logs.

The distal ends 140 of the handle plunger rods 120 are secured to the hand grips 114, 116. The hand grip 114 that is secured to the distal end of the first telescoping handle 106 is configured to extend outwardly by some predefined distance, such as one or two inches, from centerline axis 142 of the log splitting tool 100. Here, wherein the first telescoping handle 106 and the second telescoping handle 108 are co-aligned along the axis 142 of the log splitting tool 100 when the cutting wedge 102 and the splitting wedge 104 are adjacent to each other to form the unitary body wedge.

The hand grip 116 that is secured to the distal end of the first telescoping handle 106 is similarly configured to extend outwardly by the predefined distance from centerline 142 of the log splitting tool 100. Accordingly, after the unitary body wedge has been driven into the surface of the log, the user is then able to conveniently grasp the hand grips 114, 116 since the separation between the hand grips 114, 116 provides sufficient room to accommodate the user's hands as they grasp the hand grips 114, 116. Any suitable predefined distance that the hand grips 114, 116 extend outwardly from the centerline axis 142 may be used.

In an alternative embodiment, the hand grips 114, 116 do not extend outwardly from the centerline 142. A suitable gripping means may be disposed on the hand grips 114, 116 to facilitate the user's grasp of the hand grips 114, 116. In some embodiments, one or more protrusions may extend outwardly from the hand grips 114, 116 that enable the user to grasp the hand grips 114, 116. In another example embodiment, a portion of the inside surfaces of the hand grips 114, 116 are removed, or the inside surfaces of the hand grips 114, 116 extend inwardly, to enable the user to grasp the hand grips 114, 116.

The handle connecting hinge 112 is coupled to a proximal end of the cutting wedge 102 and to a proximal end of the splitting wedge 104. Accordingly, the handle connecting hinge 112 joins the first telescoping handle 106 with the affixed cutting wedge 102 to the second telescoping handle 108 with the affixed splitting wedge 104 as illustrated to define a pivot point for the handles 106, 108. In an example embodiment, the handle connecting hinge 112 facilitates the outward separation of the splitting wedge 104 from the cutting wedge 102 when the user spreads the hand grips 114, 116 apart along a horizontal plane to split the log.

In the illustrated example embodiment, the two hinge loops 122 are coupled to the opposing end of the splitting wedge 104 in an outwardly protruding manner. The two hinge loops 122 are spaced apart so as to receive the hinge barrel 124. The hinge barrel 124 is coupled to the opposing end of the cutting wedge 102 in an outwardly protruding manner. During fabrication, when the hinge barrel 124 is placed between the two hinge loops 122, the connecting pin 126 is inserted through the holed of the two hinge loops 122 and a corresponding hole disposed through the center of the hinge barrel 124. The connecting pin 126 is then secured in position so that the hinge barrel 124 and the two hinge loops 122 are able to freely rotate about the connecting pin 126 when the user spreads the hand grips 114, 116 apart along a horizontal plane to split the log. In an example embodiment, the connecting pin 126 may be secured with a nut, a carter pin, a locking screw, a rivet head, a weld, an adhesive, or the like.

In a preferred embodiment, the two hinge loops 122 are secured to the proximal end of a first brace 144. The distal end of the brace 144 is secured to the end proximal surface 146 of the splitting wedge 104. The hinge barrel 124 is secured to the proximal end of a second brace 148. The distal end of the brace 148 is secured to the proximal end surface 150 of the cutting wedge 102. The advantage of the braces 144 and 148 provide the advantage of reinforcing the strength of the log splitting tool 100 when the unitary body wedge (formed by joining the cutting wedge 102 and the splitting wedge 104 together) is driven into the surface of the log. In other embodiments, the two hinge loops 122 and the hinge barrel 124 may be secured to the splitting wedge 104 and the cutting wedge 102, respectively, using other connecting means such as a bar or tube of strong metal.

Preferably, the axis 152 of the handle connecting hinge 112 extends outwardly from the unitary body wedge (formed by joining the cutting wedge 102 and the splitting wedge 104 together) by some predefined distance D. The extension of the handle connecting hinge 112 from the unitary body wedge increases the leverage effect of the cutting wedge 102 and the splitting wedge 104 as they are separated when the user spreads the hand grips 114, 116 apart along a horizontal plane to split the log. Any suitable predefined distance D may be used in the various embodiments.

The example handle connecting hinge 112 comprising the two hinge loops 122 and the hinge barrel 124 are employed in a preferred embodiment. In alternative embodiments, other types of hinges or hinge devices may be used to provide the leveraged pivot point for the first telescoping handle 106 with the cutting wedge 102 and the second telescoping handle 108 with the splitting wedge 104.

Figure 3:
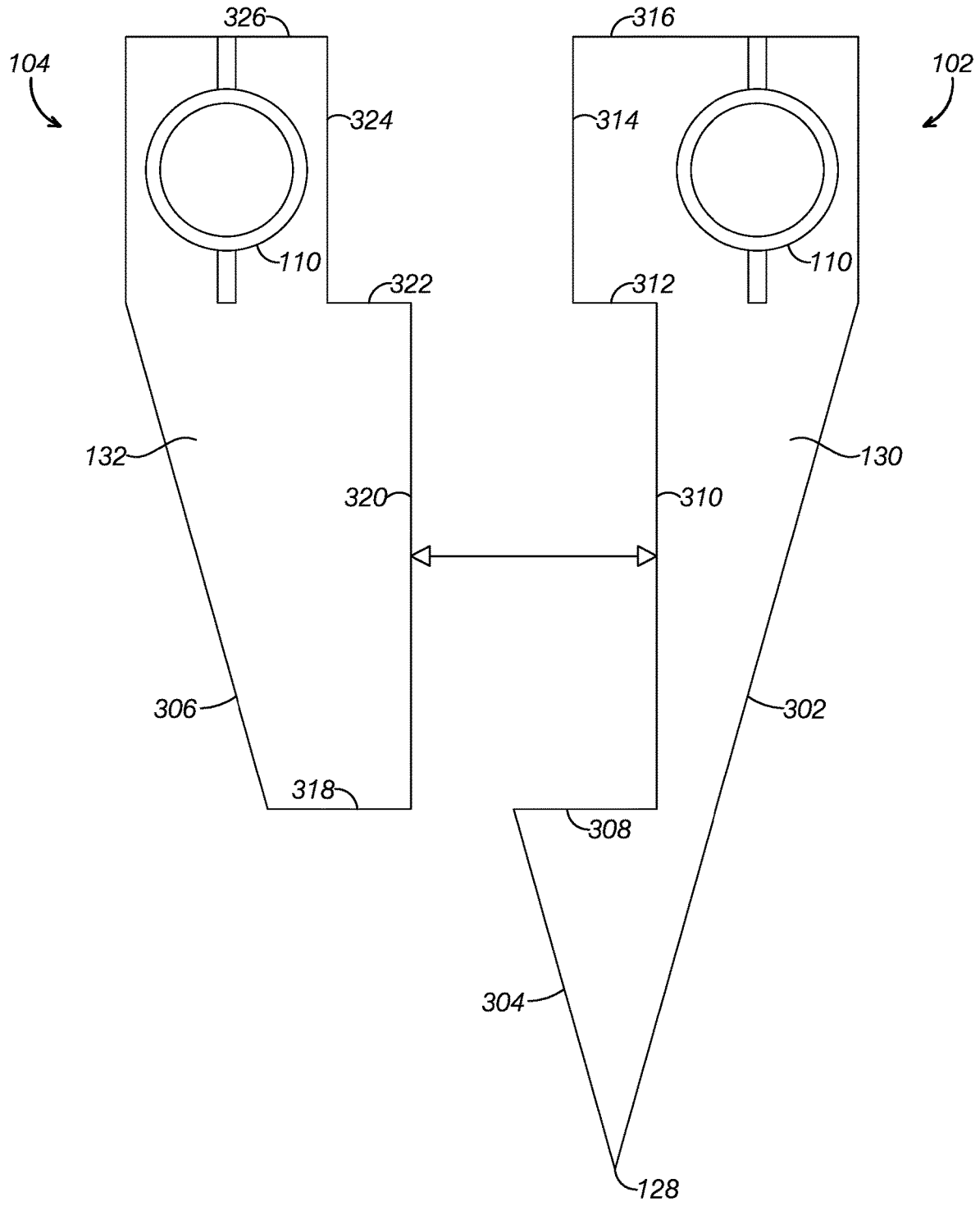
FIG. 3 is a cross sectional view of the log splitting tool 100 showing the end 130 of the cutting wedge 102 and the end 132 of the splitting wedge 104.

FIG. 3 is a cross sectional view of the log splitting tool 100 showing the end surface 130 of the cutting wedge 102 and the end surface 132 of the splitting wedge 104. When the cutting wedge 102 and the splitting wedge 104 are joined together to define the unitary body wedge, the end surfaces 130, 132 define the beard of the unitary body wedge.

Preferably, the cutting edge 128 is curved to some degree to form the bit of the unitary body wedge. By having the cutting edge 128 limited to the cutting wedge 102, the user is able to sharpen the unitary body wedge at a convenient time.

One exterior side surface 302 of the cutting wedge 102 defines the first cheek of the unitary body wedge. When the cutting wedge 102 and the splitting wedge 104 are joined together to define the unitary body wedge, the exterior side surface 304 of the cutting wedge 102 and the exterior side surface 306 of the splitting wedge 104 define the opposing cheek of the unitary body wedge.

The cutting wedge 102 is further defined by a first wedge rest 308, a first interior side surface 310, an optional first wedge stop 12, a second interior side surface 314 and a top surface 316. The first wedge rest 308 is located at a lower edge of the first interior side surface 310, and is oriented perpendicular to, or substantially perpendicular to, the first interior side surface 310. The first wedge stop 312 is located at an upper edge of the first interior side surface 310, and is oriented perpendicular to, or substantially perpendicular to, the first interior side surface 310. The second interior side surface 314 is vertically aligned with, or is substantially vertically aligned with, the interior side surface 310, and extends further out than the first interior side surface 310.

The splitting wedge 104 is further defined by a second wedge stop 318, a third interior side surface 320, an optional second wedge rest 322, a fourth interior side surface 324, and a top surface 326. The wedge stop 318 is located at a lower edge of the interior side surface 320, and is oriented perpendicular to, or substantially perpendicular to, the interior side surface 320. The wedge rest 322 is located at an upper edge of the interior side surface 320, and is oriented perpendicular to, or substantially perpendicular to, the interior side surface 320. The interior side surface 324 is vertically aligned with, or is substantially vertically aligned with, the first interior side surface 320, and extends further in than the interior side surface 320.

When the cutting wedge 102 and the splitting wedge 104 are joined together to define the unitary body wedge, the wedge stop 318 of the splitting wedge 104 rests upon the wedge rest 308 of the cutting wedge 102. Further, the wedge stop 312 of the cutting wedge 102 rests on the wedge rest 322 of the splitting wedge 104. The interior side 310 of the cutting wedge 102 and the interior side 320 are adjacent to each other, and are preferably in contact with each other to provide support. Similarly, the interior side 314 of the cutting wedge 102 and the interior side 324 are adjacent to each other, and are preferably in contact with each other to provide support.

When the user then swings the log splitting tool 100 in an overhead arc, forcibly driving the unitary body wedge downward and into the upper surface of the log that is to be split, all of the upward directed resistance forces exerted by the log are made to the cutting wedge 102. Since the log does not come into contact with the splitting wedge 104, the log does not directly exert resistance forces on the splitting wedge 104 that would otherwise cause undesirable deformation of the log splitting tool 100. Further, the momentum of the splitting wedge 104 exerts a downward force from the wedge stop 318 onto the wedge rest 308, thereby further increasing the downward force of the unitary body wedge as it is being driven into the top surface of the log. Also, the force exerted by the wedge stop 312 of the cutting wedge 102 onto the wedge rest 322 of the splitting wedge 104 tends to secure the splitting wedge 104 so that the splitting wedge 104 does not separate from the cutting wedge 102 when the cutting wedge 102 is being driven downward into the surface of the log.

In embodiments that omit the wedge rest 322 and the wedge stop 312, the interior surfaces 310 and 314 of the cutting wedge 102 are substantially aligned with each other. Similarly, the interior surfaces 320 and 324 of the splitting wedge 104 are substantially aligned with each other. When the cutting wedge 102 and the splitting wedge 104 are joined together to define the unitary body wedge, the inside surfaces 310, 314 and the inside surfaces 320, 322 are adjacent to each other, and are preferably in contact with each other to provide support.

In a preferred embodiment, the top surface 316 of the cutting wedge 102 and the top surface 326 of the splitting wedge 104 are flat and are configured to align with each other when the cutting wedge 102 and the splitting wedge 104 are joined together to define the unitary body wedge to define a top flat surface. Accordingly, after the unitary body wedge has been partially embedded into the surface of the log that is to be split, the user may strike the flat top surface of the unitary body wedge (the aligned top surfaces 316, 326) with a hammer, mallet, or the like to further force the unitary body wedge downward into the log.

Figure 4:
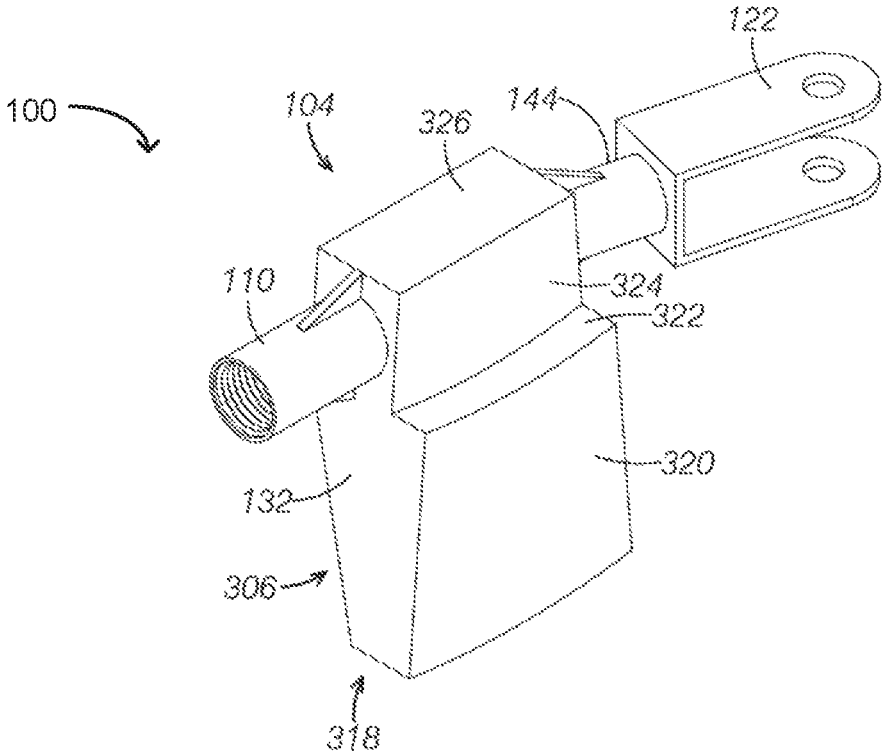
FIG. 4 is a perspective view of an example embodiment of a splitting wedge of the log splitting tool.
Figure 5:
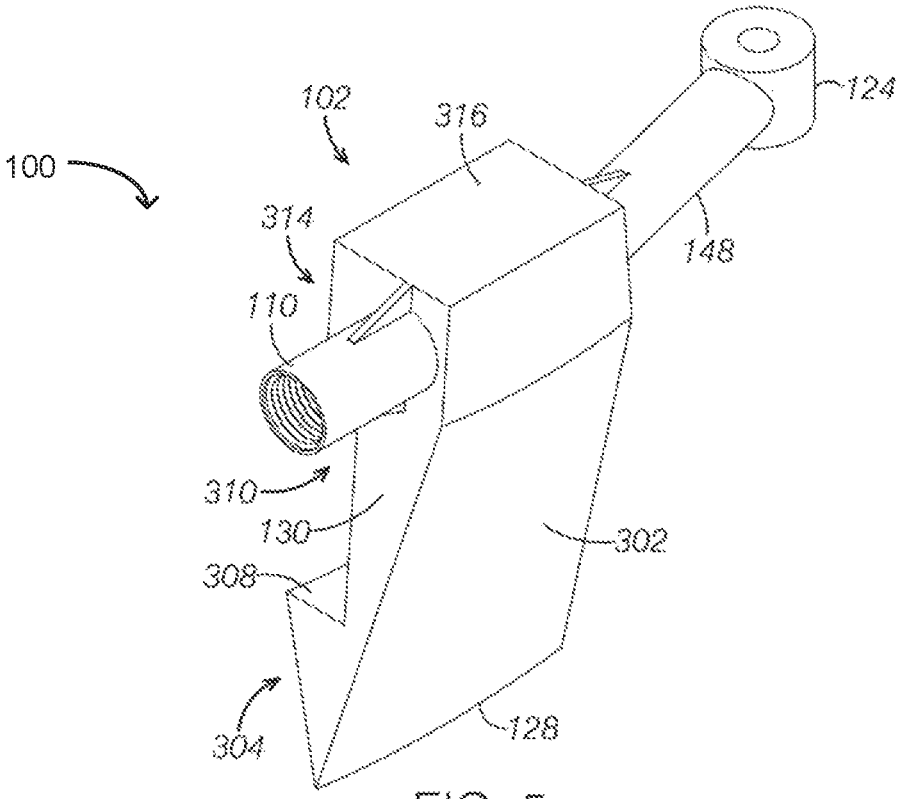
FIG. 5 is a perspective view of an example embodiment of a cutting wedge of the log splitting tool.

FIG. 4 is a perspective view of an example embodiment of a splitting wedge 104 of the log splitting tool 100. FIG. 5 is a perspective view of an example embodiment of a cutting wedge 102 of the log splitting tool 100.

Figure 6:
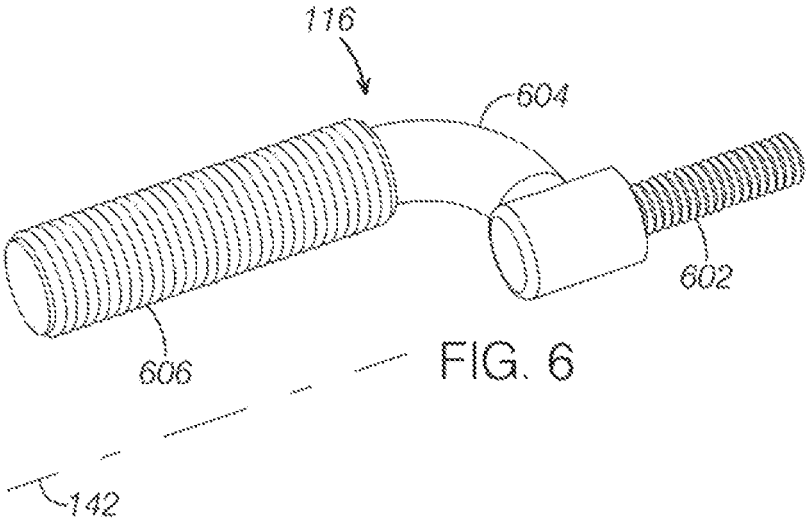
FIG. 6 is a perspective view of an example embodiment of a handle grip of the log splitting tool.
Figure 7:
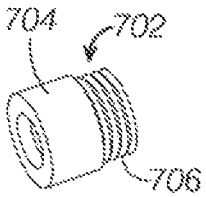
FIG. 7 is a perspective view of an example embodiment of a handle grip securing nut of the log splitting tool.
Figure 8:
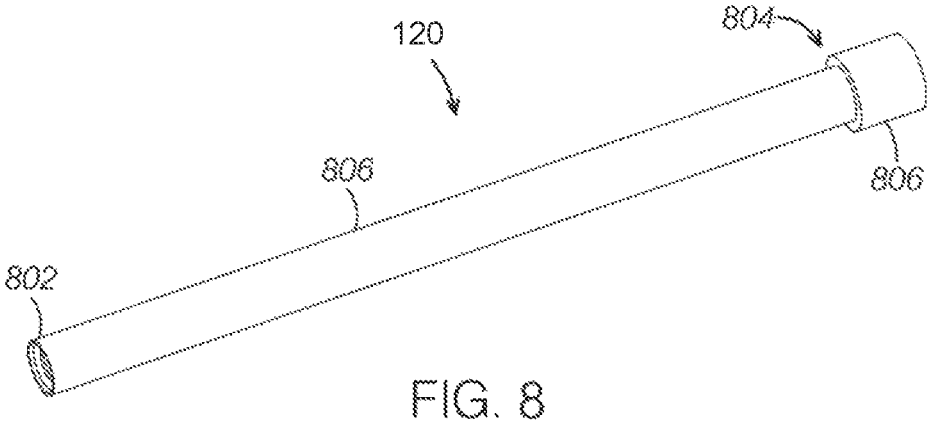
FIG. 8 is a perspective view of an example embodiment of a telescoping handle plunger rod of the log splitting tool
Figure 9:
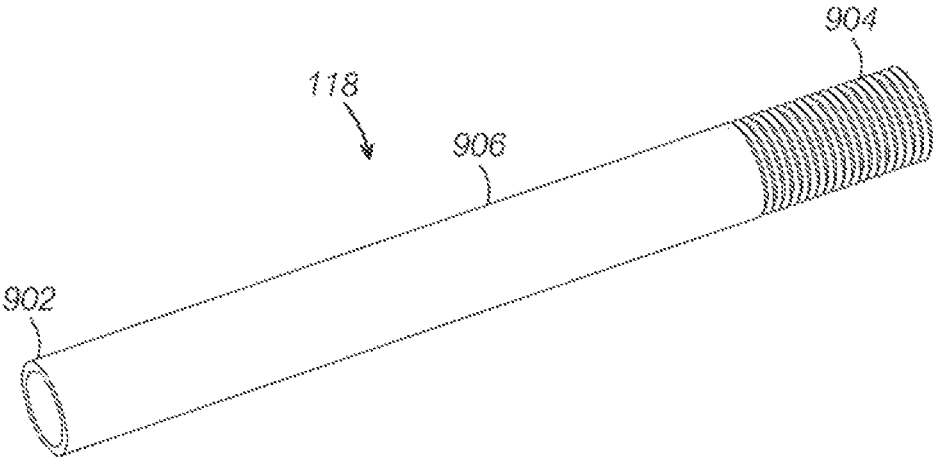
FIG. 9 is a perspective view of an example embodiment of a telescoping handle barrel sleeve of the log splitting tool

FIG. 6 is a perspective view of an example embodiment of a handle grip 116 of the log splitting tool 100. FIG. 7 is a perspective view of an example embodiment of a handle grip securing nut 702 of the log splitting tool 100. FIG. 8 is a perspective view of an example embodiment of a telescoping handle plunger rod 120 of the log splitting tool 100. And, FIG. 9 is a perspective view of an example embodiment of a telescoping handle barrel sleeve 118 of the log splitting tool 100.

The proximal end 602 of the handle grip 116 has a threaded outside surface that is configured to be screwed into a hole at the distal end 704 of the handle grip securing nut 702, which has corresponding mating threads that receive the threads of the outside surface of the proximal end 602. A middle portion 604 of the handle grip 116 extends outwardly from the centerline 142 of the log splitting tool 100, thereby providing room for the hands of the user who is gripping the handles 114, 116. The distal end 606 of the handle grip 116 may be optionally covered with a suitable material to enhance the comfort of the user and to reduce the likelihood of slippage during use. The handle grip 114 is similarly constructed.

The exterior surface of the proximal end 706 of the handle grip securing nut 702 is threaded in this example embodiment. The proximal end 706 is screwed into a hole at the distal end 802 of the handle plunger rod 120, which has corresponding mating threads that receive the threads of the outside surface of the proximal end 706.

The proximal end 804 of the handle plunger rod 120 may be optionally fitted with an optional guide ring 806. The guide ring 806 facilitates the sliding of the handle plunger rod 120 into the distal end 902 and within the interior of the barrel sleeve 118. Preferably, the guide ring 806 is made of a material that has a low coefficient of friction.

The middle portion 806 of the handle plunger rod 120 has a length that corresponds to the length of the middle portion 906 of the barrel sleeve 118. When the handle plunger rod 120 is fully inserted into the interior of the barrel sleeve 118, the proximal end 804 of the handle plunger rod 120 is in proximity to the proximal end 904 of the barrel sleeve 118. When the handle plunger rod 120 is fully inserted, in a preferred embodiment, the log splitting tool 100 is configured so that the user may then swing the log splitting tool 100 in an overhead arc, forcibly driving the unitary body wedge downward and into the upper surface of the log that is to be split.

Figure 10:
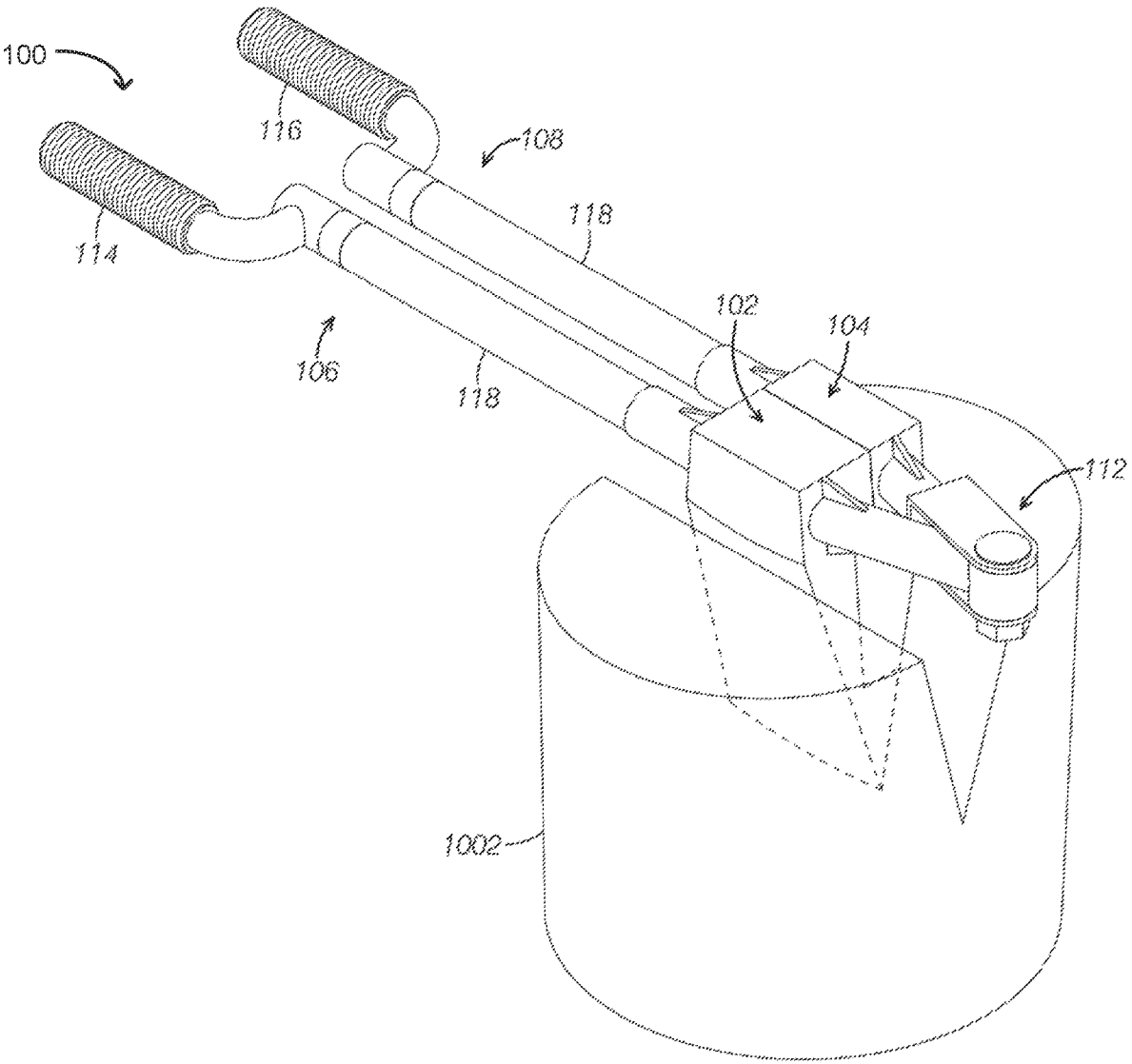
FIG. 10 is a perspective view of an example embodiment of the cutting wedge and the splitting wedge together embedded in a log.

FIG. 10 is a perspective view of an example embodiment of the cutting wedge 102 and the splitting wedge 104 together embedded in a log 1002. FIG. 1I is a perspective view of an example embodiment of the cutting wedge and the splitting wedge forcibly separated to split the log 1002. Here, the handle plunger rod 120 is illustrated as being fully inserted into the barrel sleeve 118. In practice, the user spreads the hand grips 114, 116 apart along a horizontal plane 1102 to split the log 1002. If the log 1002 is relatively small or, or is a relatively easy-to-split log, then the user does not necessarily need to pull out the handle plunger rod 120 from the barrel sleeve 118 to effect the splitting of the log 1002.

Figure 11:
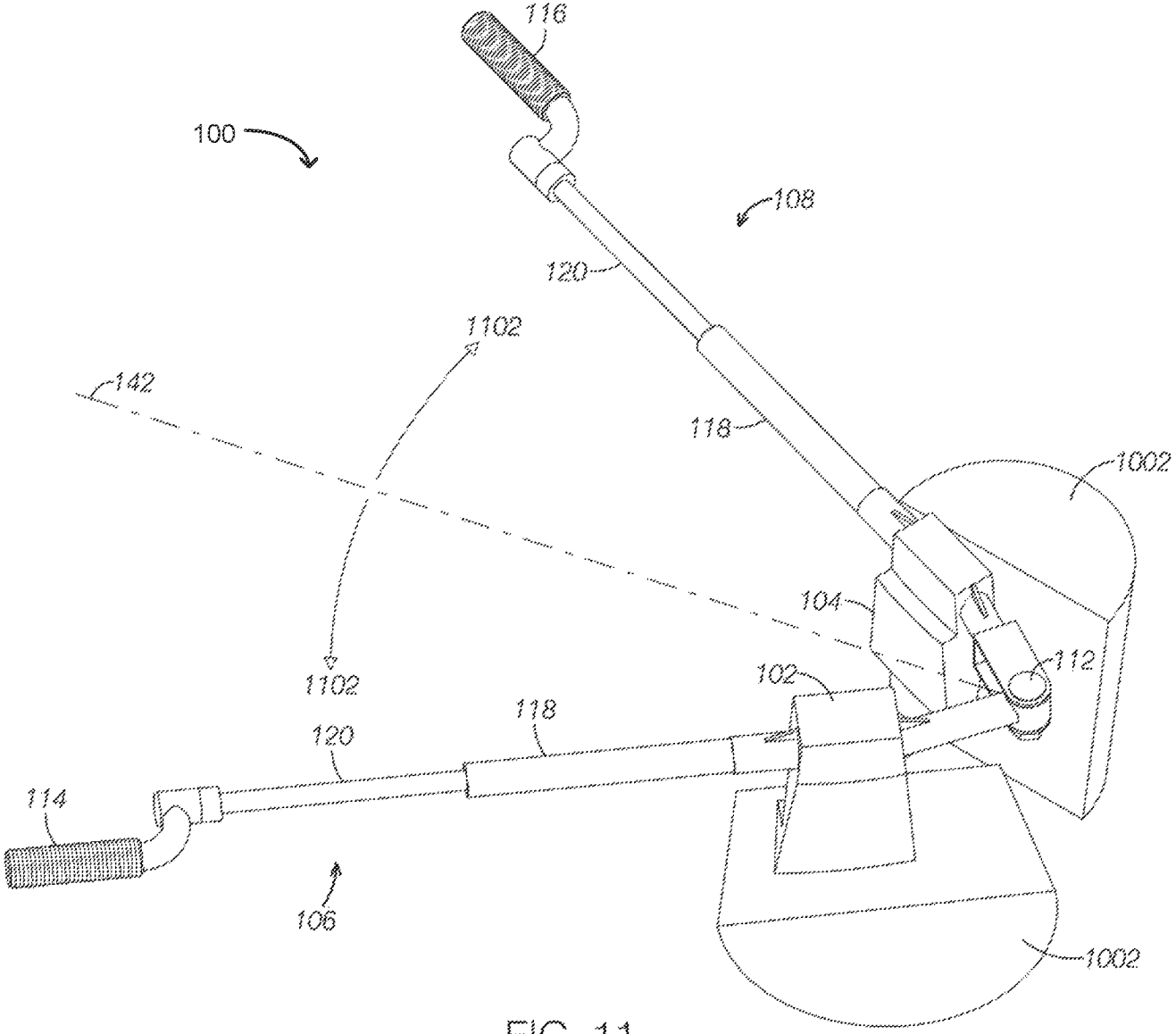
FIG. 11 is a perspective view of an example embodiment of the cutting wedge and the splitting wedge forcibly separated to split the log.

However, some logs 1002 may be difficult to split. To obtain additional leverage for splitting the log 1002, the user may extend the handle plunger rod 120 out from the barrel sleeve 118 so as to increase the length of the first telescoping handle 106 and the second telescoping handle 108. FIG. 11 is a perspective view of an example embodiment of the cutting wedge 102 and the splitting wedge 104 forcibly separated to split the log. Here, the extended length of the first telescoping handle 106 and the second telescoping handle 108 has increased the user's leverage, thereby facilitating splitting of the log 1002 as illustrated.

Figure 12:
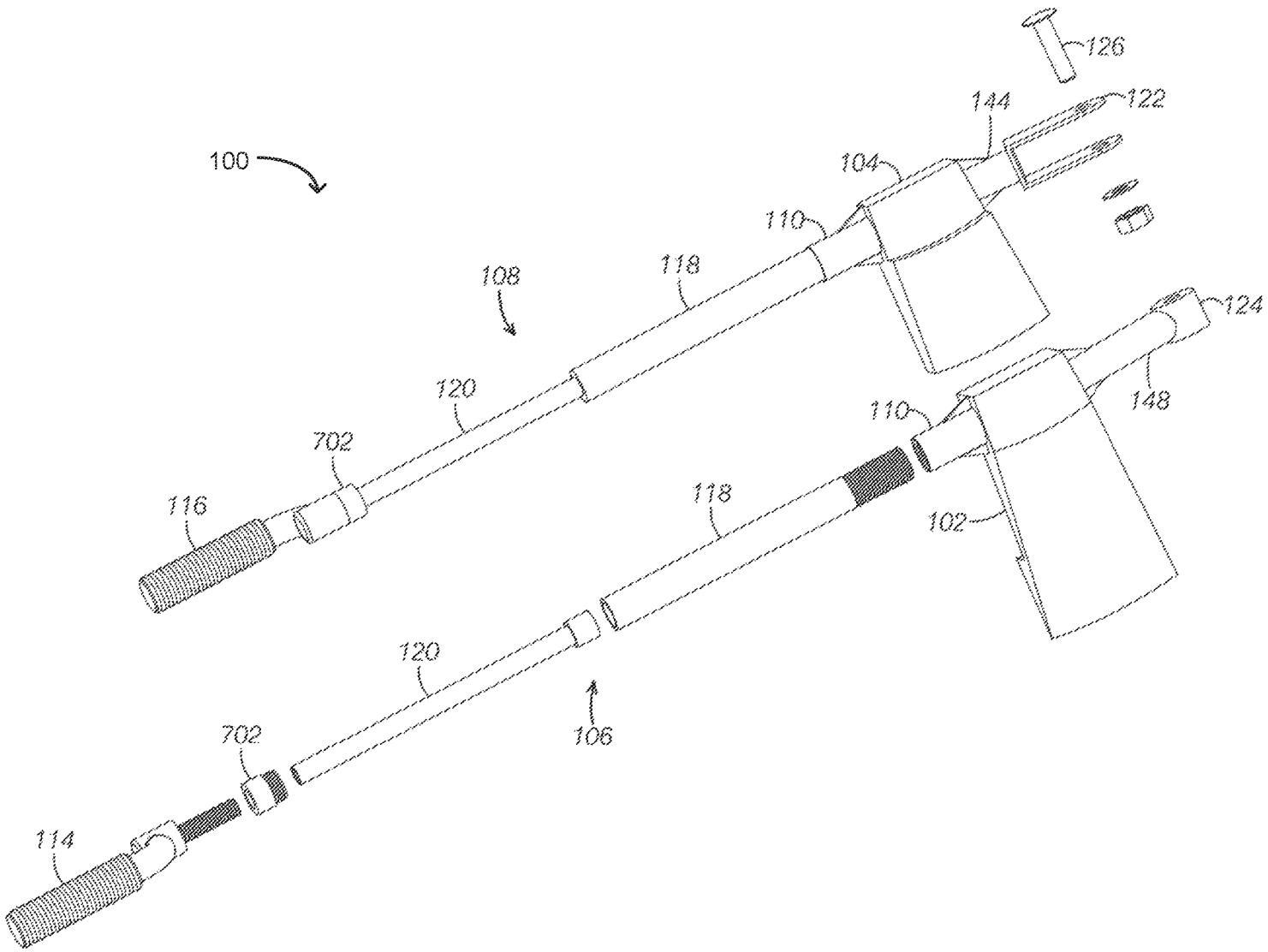
FIG. 12 is an exploded parts view of an embodiment of the log splitting tool.

FIG. 12 is an exploded parts view of an example embodiment of the log splitting tool 100. Alternative embodiments may have more components (not illustrated) or fewer components than the example log splitting tool 100 of FIG. 12.

It should be emphasized that the above-described embodiments of the log splitting tool 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. A log splitting tool, comprising:

a first handle defined by a proximal end and a distal end;

a second handle defined by a proximal end and a distal end; and a cutting wedge with a proximal end and with a distal end that is coupled to the proximal end of the first handle, the the cutting wedge terminating in a cutting edge; and a splitting wedge with a proximal end and with a distal end that is coupled to the proximal end of the second handle, wherein the splitting wedge terminates in a wedge stop that is facing a same direction as the cutting edge of the cutting wedge, and wherein the wedge stop is offset from the cutting edge, wherein the proximal end of the cutting wedge is movably connected to the proximal end of the splitting wedge so that the wedges move between a closed unified body position an open position, wherein the wedge stop is completely inside of the cutting wedge when the wedges are in the closed unified body position, wherein the splitting wedge is spaced from the cutting wedge when the wedges are in the open position, wherein the first handle and the second handle are parallel along a longitudinal axis of the log splitting tool when in the closed unified body position, wherein as a user swings the log splitting tool in the closed unified body position in an overhead arc, the cutting edge is forcibly driven downward into an upper surface of a log that is to be split, and wherein the user then spreads the first handle and the second handle apart in opposing directions forcing the cutting wedge and the splitting wedge to move to the open position thereby causing the log to split.

2. The log splitting tool of claim 1, wherein the cutting wedge is defined by a first exterior side surface that is a first cheek when the wedges are in the closed unified body position, wherein the cutting wedge is defined by a second exterior side surface opposing the first exterior side surface, wherein the splitting wedge is defined by an exterior side surface, and wherein the second exterior side surface of the cutting wedge and the exterior side surface of the splitting wedge align together to define a second cheek that opposes the first cheek when the wedges are in the closed unified body position.

3. The log splitting tool of claim 1, wherein the cutting wedge is defined by a first interior side surface, wherein the cutting wedge is defined by a wedge rest extending out substantially perpendicular from a lower edge of the first interior side surface, wherein the splitting wedge is defined by a second interior side surface, wherein the splitting wedge is defined by the wedge stop extending out substantially perpendicular from a lower edge of the second interior side surface, and wherein the wedge stop of the splitting wedge lies on top of the wedge rest of the cutting wedge when the cutting wedge and the splitting wedge are adjacent to each other when the wedges are in the closed unified body position.

4. The log splitting tool of claim 3, wherein the first interior side surface of the cutting wedge is adjacent to the second interior side surface of the splitting wedge when the wedges are in the closed unified body position.

5. The log splitting tool of claim 3, wherein the wedge rest of the cutting wedge is a first wedge rest, wherein the wedge stop of the splitting wedge is a first wedge stop, wherein the cutting wedge is further defined by a second wedge stop extending out substantially perpendicular from an upper edge of the first interior side surface, wherein the splitting wedge is further defined by a second wedge rest extending out substantially perpendicular from an upper edge of the second interior side surface, and wherein the second wedge stop of the cutting wedge lies on top of the second wedge rest of the splitting wedge when the wedges are in the closed unified body position.

6. The log splitting tool of claim 1, wherein the cutting wedge is defined by a first top surface that is flat, wherein the splitting wedge is defined by a second top surface that is flat, and wherein the flat first top surface of the cutting wedge and the flat second top surface of the splitting wedge align together to define a flat top when the wedges are in the closed unified body position.

7. The log splitting tool of claim 1, wherein the cutting wedge is defined by a first end surface, wherein the splitting wedge is defined by a second end surface, and wherein the first end surface and the second end surface define a beard of the unitary body wedge when the wedges are in the closed unified body position.

8. The log splitting tool of claim 1, further comprising:

a first brace that couples the proximal end of the first handle to the distal end of the cutting wedge; and a second brace that couples the proximal end of the second handle to the distal end of the splitting wedge.

9. The log splitting tool of claim 1, further comprising:
a handle connecting hinge,
wherein the handle connecting hinge is coupled to the proximal end of the cutting wedge and is coupled to the proximal end of the splitting wedge, and
wherein the handle connecting hinge is a pivot point between the first handle and the second handle.

10. The log splitting tool of claim 9, wherein the handle connecting hinge further comprises:
two hinge loops that are coupled to the proximal end of the splitting wedge;
a hinge barrel that is coupled to the proximal end of the cutting wedge; and
a connecting pin that passes through apertures in the hinge barrel and the two hinge loops.

11. The log splitting tool of claim 10, further comprising:
a first brace coupled to the two hinge loops and coupled to the proximal end of the splitting wedge; and
a second brace coupled to the hinge barrel and coupled to the proximal end of the cutting wedge;
wherein the first brace and the second brace cooperatively extend the pivot point of the handle connecting hinge away from the proximal ends of the cutting wedge and the splitting wedge by a predefined distance,
wherein the predefined distance increases a leverage of the cutting wedge and the splitting wedge.

12. The log splitting tool of claim 1,
wherein the first handle is a first telescoping handle,
wherein the second handle is a second telescoping handle,
wherein the first telescoping handle comprises:
a first tubular barrel sleeve, wherein the proximal end of the first tubular barrel sleeve couples the first telescoping handle to the cutting wedge; and
a first handle plunger rod configured to slide into the first tubular barrel sleeve,
wherein the second telescoping handle comprises:
a second tubular barrel sleeve, wherein the proximal end of the second tubular barrel sleeve couples the second telescoping handle to the splitting wedge; and
a second handle plunger rod configured to slide into the second tubular barrel sleeve,
wherein a first length of the first telescoping handle is increased when the first handle plunger rod is extended outward from the first tubular barrel sleeve,
wherein a second length of the second telescoping handle is increased when the second handle plunger rod is extended outward from the second tubular barrel sleeve, and
wherein the increased first length of the first telescoping handle and the increased second length of the second telescoping handle increase a leverage of the cutting wedge and the splitting wedge when the user spreads the first handle and the second handle apart in opposing directions to cause the log to split.

13. The log splitting tool of claim 12,
wherein the first length of the first telescoping handle is decreased when the first handle plunger rod is pushed inward into the first tubular barrel sleeve,
wherein the second length of the second telescoping handle is decreased when the second handle plunger rod is pushed inward into the second tubular barrel sleeve, and
wherein the decreased first length of the first telescoping handle and the decreased length of the second telescoping handle enable the user to swing the log splitting tool in the overhead arc to forcibly drive the unitary body wedge downward and into the upper surface of the log that is to be split.

14. The log splitting tool of claim 1, further comprising:
a first handle grip defined by a first proximal end that is coupled to the distal end of the first handle; and
a second handle grip defined by a second proximal end that is coupled to the distal end of the second handle,
wherein the first handle grip is separated from the second handle grip by a predefined distance so that hands of the user are able to separately grasp the first handle grip and the second handle grip.

15. A unitary body wedge, comprising:
a cutting wedge with a proximal end and with a distal end that is coupled to a proximal end of a first handle, the cutting wedge terminating in a cutting edge; and
a splitting wedge with a proximal end and with a distal end that is coupled to a proximal end of a second handle,
wherein the splitting wedge terminates in a wedge stop that is facing a same direction as the cutting edge of the cutting wedge, and
wherein the wedge stop is offset from the cutting edge,
wherein the proximal end of the cutting wedge is movably connected to the proximal end of the splitting wedge so that the wedges move between a closed unified body position an open position,
wherein the wedge stop is completely inside of the cutting wedge when the wedges are in the closed unified body position,
wherein the splitting wedge is spaced from the cutting wedge when the wedges are in the open position,
wherein the first handle and the second handle are parallel along longitudinal axis of the log splitting tool when the wedges are in the closed unified body position,
wherein as a user grasps the first handle and the second handle to swing the wedges of log splitting tool when in the closed unified body position in an overhead arc, the cutting edge is forcibly driven downward into an upper surface of a log that is to be split, and
wherein the user then spreads the first handle and the second handle apart in opposing directions forcing the cutting wedge and the splitting wedge to move into open position thereby causing the log to split.

16. The unitary body wedge of claim 15,
wherein the cutting wedge is defined by a first exterior side surface that is a first cheek when the wedges are in the closed unified body position,
wherein the cutting wedge is defined by a second exterior side surface opposing the first exterior side surface,
wherein the splitting wedge is defined by an exterior side surface, and
wherein the second exterior side surface of the cutting wedge and the exterior side surface of the splitting wedge align together to define a second cheek that opposes the first cheek when the wedges are in the closed unified body position.

17. The unitary body wedge of claim 15,
wherein the cutting wedge is defined by a first interior side surface,
wherein the cutting wedge is defined by a wedge rest extending out substantially perpendicular from a lower edge of the first interior side surface,
wherein the splitting wedge is defined by a second interior side surface, wherein the splitting wedge is defined by the wedge stop extending out substantially perpendicular from a lower edge of the second interior side surface, and wherein the wedge stop of the splitting wedge lies on top of the wedge rest of the cutting wedge when the wedges are in the closed body position.

18. The unitary body wedge of claim 17, wherein the first interior side surface of the cutting wedge is adjacent to the second interior side surface of the splitting wedge when the wedges are in the closed unified body position.

19. The unitary body wedge of claim 18, wherein the wedge rest of the cutting wedge is a first wedge rest, wherein the wedge stop of the splitting wedge is a first wedge stop, wherein the cutting wedge is further defined by a second wedge stop extending out substantially perpendicular from an upper edge of the first interior side surface, wherein the splitting wedge is further defined by a second wedge rest extending out substantially perpendicular from an upper edge of the second interior side surface, and wherein the second wedge stop of the cutting wedge lies on top of the wedge rest of the splitting wedge when the wedges are in the closed unified body position.

20. The unitary body wedge of claim 15, wherein the first handle is a first telescoping handle, wherein the second handle is a second telescoping handle, wherein the first telescoping handle comprises:

a first tubular barrel sleeve, wherein the proximal end of the first tubular barrel sleeve couples the first telescoping handle to the cutting wedge; and a first handle plunger rod configured to slide into the first tubular barrel sleeve, wherein the second telescoping handle comprises:

a second tubular barrel sleeve, wherein the proximal end of the second tubular barrel sleeve couples the second telescoping handle to the splitting wedge; and a second handle plunger rod configured to slide into the second tubular barrel sleeve, wherein a first length of the first telescoping handle is increased when the first handle plunger rod is extended outward from the first tubular barrel sleeve, wherein a second length of the second telescoping handle is increased when the second handle plunger rod is extended outward from the second tubular barrel sleeve, and wherein the increased first length of the first telescoping handle and the increased length of the second telescoping handle increase a leverage of the cutting wedge and the splitting wedge when the user spreads the first handle and the second handle apart in opposing directions to cause the log to split.

* * * * *